US006977100B2

(12) United States Patent
Kondo et al.

(10) Patent No.: US 6,977,100 B2
(45) Date of Patent: Dec. 20, 2005

(54) INK-JET RECORDING MATERIAL SUITABLE FOR PIGMENT INK

(75) Inventors: Noboru Kondo, Tokyo (JP); Teiichi Otani, Tokyo (JP); Atsushi Ono, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 10/754,635

(22) Filed: Jan. 12, 2004

(65) Prior Publication Data

US 2004/0209011 A1 Oct. 21, 2004

Related U.S. Application Data

(63) Continuation-in-part of application No. 09/771,964, filed on Jan. 30, 2001, now abandoned.

(30) Foreign Application Priority Data

Jan. 31, 2000 (JP) ..... 2000-023431
Jan. 17, 2001 (JP) ..... 2001-008679

(51) Int. Cl.[7] ..... B41M 5/50
(52) U.S. Cl. ..... 428/32.25; 428/32.34; 427/243; 347/105

(58) Field of Search ..... 428/32.25, 32.34, 428/323, 330, 689, 696, 698; 427/243; 347/105

(56) References Cited

U.S. PATENT DOCUMENTS 5,500,668 A * 3/1996 Malhotra et al. ..... 347/105
6,254,958 B1 * 7/2001 Yoshida et al. ..... 428/64.2
6,268,101 B1 * 7/2001 Yacobucci et al. ..... 430/124
6,326,323 B1 * 12/2001 Shimano et al. ..... 428/32.16
6,350,507 B1 * 2/2002 Iwamoto et al. ..... 428/32.33
6,555,207 B2 * 4/2003 Kondo et al. ..... 427/146

* cited by examiner

*Primary Examiner*—B. Shewareged
(74) *Attorney, Agent, or Firm*—Millen, White, Zelano & Branigan, P.C.

(57) ABSTRACT

An ink-jet recording material having on a support at least one ink-receiving layer comprising pigment and binder, which further contains in the uppermost layer of the ink-receiving layers at least one water-soluble acidic or neutral salt selected from the group consisting of aluminum salts, magnesium salts, sodium salts, potassium salts and zinc salts, and thereby acquires suitability for an ink-jet recording process using pigment ink.

19 Claims, No Drawings

INK-JET RECORDING MATERIAL SUITABLE FOR PIGMENT INK

This application is a Continuation-In-Part application of U.S. Ser. No. 09/771,964 filed Jan. 30, 2001 now abandoned.

FIELD OF THE INVENTION

The present invention relates to a recording material for ink-jet process. In particular, the invention is concerned with an ink-jet recording material that can ensure good ink absorption and excellent color reproduction even when images are recorded thereon by a full color ink-jet process using pigment ink.

BACKGROUND OF THE INVENTION

The ink-jet recording method is a recording method of forming ink images on a recording material by directing jets of ink drops at the recording material by the use of various techniques. This recording method enables high-speed and full-color printing to be easily achieved with a low noise level. In recent years, therefore, the utilization of ink-jet recording methods has been spreading at a rapid rate. According to such a method, fine drops of ink are jetted from nozzles at a high speed so as to direct toward a recording material. And a large quantity of solvent is contained in the ink used. As a result, recording materials for ink-jet recording are required to absorb ink promptly.

The recent years have also seen rapid proliferation of personal computers and digital cameras. Under these circumstances, image qualities on a level similar to those attained by silver salt photography have come to be required for images printed from digital image information. In other words, it has become necessary that, in printing images of digital information origin, recording materials can ensure high-density colors, high resolution and excellent color reproduction in the prints obtained.

In full color recording, ink-jet printers using the so-called dye ink rank as the dominant printers. This is because the dye ink generally comprises at least three kinds of ink prepared by dissolving dyes of different colors in separate portions of a solvent respectively and the dyes comprised therein as coloring ingredients are superior in point of color formation. On the other hand, ink-jet printers using the so-called pigment ink are employed for specific purposes alone under the current circumstances. The pigment ink used therein comprises at least three kinds of ink, wherein pigments of at least three different colors are dispersed as their respective main coloring ingredients and water is used as their respective main dispersion media. The purposes for using them center chiefly on the printing of rough images, e.g., wide-format images including poster. This is because the images printed in pigment ink are inferior in color reproduction though they have excellent light resistance and water resistance.

In general, ink-jet recording materials designed placing importance on ink absorption are provided with an ink-receiving layer having minute pores for promoting penetration of ink. When pigment ink is used in recording on a recording material designed for dye-ink use, it sometimes occurs that pigment particles stop up the foregoing minute pores. In this case, ink absorption becomes bad, and pigments as coloring ingredients are confined within a very thin surface region of the ink-receiving layer. As a result, the rubbing resistance of recorded images deteriorates.

On the other hand, when the pores present in an ink-receiving layer are greater in size than pigment particles, the pigments as coloring ingredients penetrate too deeply in the ink-receiving layer. As a result, the images recorded are inferior in color density and color reproduction. As matters stand, therefore, no recording materials capable of delivering both excellent color reproduction and high ink absorption when pigment ink is used are known yet.

As an answer to such a problem, Japanese Tokkai Hei 10-119417 (the term "Tokkai" as used herein means an "unexamined published patent application") proposes providing a layer which can swell in ink by containing a water-soluble resin on an ink penetration layer containing an inorganic filler. However, such an ink absorption layer is slow in ink drying speed, and so it has an image formation problem.

Further, Japanese Tokkai Hei 11-254818 discloses the recording sheet provided with an ink-receiving layer containing silica grains. However, such a sheet has insufficient color reproduction.

SUMMARY OF THE INVENTION

Therefore, an object of the invention is to provide a recording material suitable for an ink-jet process using pigment ink, which can well absorb pigment ink, cause no bleed and ensure high color density and excellent color reproduction when images are printed thereon with a printer using pigment ink.

The aforementioned object is attained with an ink-jet recording material suitable for pigment ink, which has on a support at least one ink-receiving layer comprising pigment and binder: with the uppermost layer of the ink-receiving layers further containing at least one water-soluble metal salt which is selected from the group consisting of aluminum salts, magnesium salts, sodium salts, potassium salts and zinc salts and presents a pH around 7 or below when dissolved in water (namely, which is neutral or acidic), thereby achieving the invention.

In particular, when the anion constituting the water-soluble metal salt selected from the foregoing group is at least one anion selected from the group consisting of sulfate ion, chloride ion, thiosulfate ion, nitrate ion and acetate ion, more excellent color reproduction can be attained.

DETAILED DESCRIPTION OF THE INVENTION

The term "pigment ink" as used in the invention is intended to include not only unmixed pigment ink but also ink mixtures of at least 50 weight % of pigment ink and less than 50 weight % of dye ink, or the so-called dye-pigment ink.

The coloring component of pigment ink may be any of organic and inorganic pigments, and it is present in a state of being dispersed in an ink solvent.

Aluminum salts, magnesium salts, sodium salts, potassium salts and zinc salts used in the invention are required to be salts soluble in water at room temperature.

Suitable anions as constituents of such salts include sulfate ion, chloride ion, thiosulfate ion, nitrate ion and acetate ion. Of these anions, sulfate and thiosulfate ions are preferred over the others. In particular, sulfate ion is used to advantage because it can produce great effect in only a small amount. Examples of a water-soluble salt suitable for the invention include aluminum sulfate, magnesium sulfate, sodium thiosulfate and potassium thiosulfate.

From the viewpoints of color reproduction of recorded images and production cost of recording materials, magnesium sulfate is most suitable as a water-soluble salt used in the invention. Additionally, two or more of the water-soluble metal salts recited above may be used as a mixture in the present recording material.

Of the ink-receiving layers that are provided on a support to constitute the present recording material, the layer in which the present water-soluble metal salt or salts are incorporated is the outermost, i.e., the uppermost, ink-receiving layer. Preferably only the uppermost ink-receiving layer contains water-soluble metal salt or salts, e.g., the layer or layers that are not the uppermost ink-receiving layer thus contain no or substantially no water-soluble metal salt or salts. The suitable amount of water-soluble salt(s) incorporated is from 0.5 to 10 parts by weight, preferably from 0.5 to 8 parts or 1 to 8 parts by weight, per 100 parts by weight of pigment in the outermost ink-receiving layer. Since the water-soluble salts recited above have an effect of fixing pigment ink to an ink-receiving layer, they enable the ink images to have high densities and satisfactorily reproduced colors. When the amount of water-soluble salt(s) incorporated is smaller than 0.5 parts by weight, the water-soluble salt(s) cannot satisfactorily produce the effect thereof. On the other hand, when the water-soluble metal salt or salts are incorporated in an amount greater than 10 parts by weight, they may have bad influences upon ink absorption and other characteristics.

The present recording material has no particular restrictions on a support used therein. For instance, the support used may be transparent or opaque. More specifically, depending on the desired purpose thereof, the support can be selected from among various plastic films, including films of cellophane, polyethylene, polypropylene, soft polyvinyl chloride, hard polyvinyl chloride and polyester, or a wide variety of paper including wood-free paper, base paper for photographic paper, drawing paper, painting paper, coated paper, art paper, cast-coated paper, craft paper, laminated paper, impregnated paper and synthetic paper.

When the support used is a film having substantially no absorbing capacity, it is required to take a certain measure, such as a measure of increasing the coverage of an ink-receiving layer or using a pigment having higher absorbing capacity in an image-receiving layer. In the case of employing a printer having higher resolution in particular, the larger amount of ink is struck into per-unit area of a recording sheet. So, it is required for the recording sheet in its entirety to have the higher ink absorptive capacity.

The total coverage of ink-receiving layers may be determined so as to balance against the ink absorptive capacity of a support used. Specifically, the desired color reproduction can be achieved when the ink-receiving layers have their total coverage within the range of 5 to 40 g/m$^2$. When the ink-receiving layers have a total coverage lower than 5 g/m$^2$, there sometimes occurs a difference in ink absorption speed at the interface between a support and the lowest ink receiving layer even when a material used as the support has a very good ink absorptive capacity. As a result, bleeding is caused noticeably in image areas, particularly in image areas of mixed colors. On the other hand, when the ink-receiving layers have their total coverage higher than 40 g/m$^2$, the ink applied thereto can penetrate deeply into them to result in lowering of coloring performance. In addition, it sometimes happens that the ink-receiving layer is powdered on the surface by slight external forces and comes off in powder or exfoliates when ink-image areas are rubbed. In other words, the ink-receiving layer surface tends to have a strength problem.

It is advantageous to provide an ink-receiving layer in a multi-layer structure from the viewpoint of improvement in ink absorptive capacity. In the case of the ink-receiving layer having a multi-layer structure, the outermost ink-receiving layer containing a water-soluble metal salt is preferably provided at a coverage of at least 3 g/m$^2$, preferably 3–8 g/m$^2$, more preferably 3–5 g/m$^2$, for serving a function as a pigment ink-fixing layer.

Suitable examples of pigments usable in the present ink-receiving layers include precipitated calcium carbonate, ground calcium carbonate, kaolin, clay, talc, titanium dioxide, zinc oxide, zinc carbonate, satin white, magnesium carbonate, magnesium silicate, calcium sulfate, calcium silicate, aluminum silicate, aluminum hydroxide, alumina sol, colloidal alumina, alumina such as psuedo-boehmite or hydrated alumina, zeolite, silica, and plastic pigments. Of these pigments, synthetic silica is preferably used in the invention. For further attaining the desired ink absorptive capacity as the coverage of ink-receiving layers is controlled to the range in which no layers come off in powder, it is favorable to use a pigment having an oil absorption of 100 to 300 cc/100 g.

Examples of a binder usable in the present ink-receiving layers include various kinds of starch, such as oxidized starch, esterified starch, enzyme-denatured starch and cationic starch, proteins such as casein and soybean protein, cellulose derivatives such as carboxymethyl cellulose and hydroxyethyl cellulose, water-soluble high molecular compounds such as polyvinyl alcohols different in saponification degree and derivatives thereof, and water-dispersible high molecular compounds such as acrylic resin emulsions, vinyl acetate resin emulsions, vinylidene chloride resin emulsions, styrene-butadiene latex, acrylonitrile-butadiene latex and a polyester dispersion. Of course, these examples should not be construed as limiting the binders usable in the present ink-receiving layers, but any materials can be employed as the binder as far as they have strong adhesion to the support and form films after drying. Such binders may be used alone or as a mixture of two or more thereof.

The suitable amount of binder added, though varies to some extent depending on the kind of pigment used together, is in the range of 5 to 60 parts by weight, preferably 10 to 50 parts by weight, per 100 parts by weight of pigment. This is because the ink-receiving layer has a surface strength problem when it contains a binder in an amount smaller than 5 parts by weight, while when the amount of binder added is larger than 60 parts by weight the ink absorptive capacity of the resulting layer becomes insufficient.

In addition, various additives, such as a thickener, an antifoaming agent, a defoaming agent, a pigment-dispersing agent, a release agent, a blowing agent, a pH controlling agent, a surface-sizing agent, a coloring dye, a coloring pigment, a fluorescent dye, a UV absorbent, an antioxidant, a light stabilizer, an antiseptic, a waterproof agent, a dye fixing agent, a surfactant and a wet paper strength increasing agent, can be added in appropriate amounts to the ink-receiving layers so far as the addition thereof does not impair the effects of the invention.

The ink-receiving layers can be provided on a support by using a known coating apparatus, such as a blade coater, a roll coater, an air knife coater, a bar coater, a curtain coater, a gravure coater, a gate roll coater, a short dwell coater and a size press, under an on-machine or off-machine condition. In addition, a transfer method can also be adopted wherein ink-receiving layers are coated on a support and a film respectively and then brought into face-to-face contact to be bonded together.

Further, various kinds of calendering apparatus, such as a machine calender, a super calender and a soft calender, can be used alone or in combination for finishing the layer surface.

The entire disclosure of all application, patents and publications, cited above and below, and of corresponding Japanese application No. 2000-23431, filed Jan. 31, 2000, and Japanese application No. 2001-008679, filed Jan. 17, are hereby incorporated by reference.

Now, specific constitutions of recording materials according to the invention are illustrated by reference to the following examples and characteristics of the present recording materials are explained by putting them in contrast with those of comparative recording materials. However, it should be understood that these examples are not to be construed as limiting the scope of the invention in any way. Unless otherwise noted, all "parts" and all "%" are by weight in the following examples and comparative examples.

Performance evaluations of recording materials prepared for pigment ink jet recording in the following Examples and Comparative Examples are made using the following methods.

Pigment Ink Jet Recording Test

The established solid and image patterns are recorded on each of recording material samples with an ink-jet printer-for pigment-ink use, HP DesignJet 2500 CP (made by HEWLETT PACKARD CO.) in which the pigment ink for exclusive use thereof is installed, and evaluated by the following criteria.

(1) Color Reproduction:

The black, cyan, magenta and yellow solid patterns are examined for their respective densities by means of a Macbeth densitometer, RD915 (made by Macbeth Co.). Color reproduction of each sample is graded by the sum total of measured values of those color densities.

⊚: 6.0<sum total of measured values

○: 5.0≦sum total of measured values≦6.0

Δ: 4.0≦sum total of measured values<5.0

×: sum total of measured values<4.0

(2) Ink Absorption:

A pattern constituted of areas solidly colored in red (mixture of magenta ink and yellow ink) and those solidly colored in green (mixture of cyan ink and yellow ink) which are arranged so as to border on one another is printed on each sample, and the extent of bleed on the borders is evaluated by visual observation according to the following criteria. Additionally, the bleed on the border between red and green areas has a black color, so the observation thereof enables clear-cut evaluation.

⊚: Absolutely no bleed is observed on the borders

○: Practically no bleed is observed on the borders

Δ: A little bleed is observed on the borders

×: Considerable bleed is observed on the borders

EXAMPLE 1

Ninety parts of hardwood kraft pulp (L-BKP) and 10 parts of softwood kraft pulp (N-BKP) were mixed, and beaten till the pulp mixture had a freeness of 350 ml in terms of csf (Canadian standard freeness). The resulting pulp was admixed with 4 parts of cationic starch, 0.3 parts of anionic polyacrylamide and 0.5 parts of an alkylketene dimer emulsion, and made into paper in a conventional way using a Fourdrinier paper machine, followed by predrying. Thereafter, a solution containing 5% of phosphorylated starch and 0.5% of polyvinyl alcohol was coated on the paper so as to have a coverage of 4 g/m$^2$ on a solids basis by means of a size press, and subjected to machine caledering treatment. The base paper thus made had a basis weight of 100 g/m$^2$.

On this base paper, the following coating Composition (1) was coated at a coverage of 10 g/m$^2$ on a solids basis by means of a bar blade coater, and treated using a calendering apparatus under a linear pressure of 80 kg/cm. Further thereon, the following coating Compositions (2) was coated with a bar blade coater so as to have a coverage of 5 g/m$^2$ on a solids basis, dried till the water content therein was reduced to 5%, and then treated using a calendering apparatus under a linear pressure of 100 kg/cm, thereby forming a ink-jet recording material having a basis weight of 115 g/m$^2$. Additionally, the following amount of every ingredient except water mixed in the coating Compositions (1) and (2) is shown on a solid basis

| | |
|---|---|
| Coating Composition (1): | |
| Synthetic silica (X-12, trade name, a product of Tokuyama Corp.) | 100 parts |
| Polyvinyl alcohol (PVA 117, trade name, a product of Kuraray Co., Ltd.) | 35 parts |
| Dye fixing agent (PAS-H-10L, trade name, a product of Nitto Boseki Co., Ltd.) | 5 parts |
| Water | 640 parts |
| Coating Composition (2): | |
| Synthetic silica (X-12, trade name, a product of Tokuyama Corp.) | 100 parts |
| Polyvinyl alcohol (PVA 117, trade name, a product of Kuraray Co., Ltd.) | 35 parts |
| Water-soluble magnesium salt (magnesium sulfate heptahydrate (on an anhydrous basis)) | 8 parts |
| Dye fixing agent (PAS-H-10L, trade name, a product of Nitto Boseki Co., Ltd.) | 5 parts |
| Water | 640 parts |

EXAMPLE 2

A recording material was prepared in the same manner as in Example 1, except that the amount of magnesium sulfate heptahydrate mixed in the coating Composition (2) was reduced to 4 parts on an anhydrous basis.

EXAMPLE 3

A recording material was prepared in the same manner as in Example 1, except that the amount of magnesium sulfate heptahydrate mixed in the coating Composition (2) was reduced to 2 parts on an anhydrous basis.

EXAMPLE 4

A recording material was prepared in the same manner as in Example 1, except that the amount of magnesium sulfate heptahydrate mixed in the coating Composition (2) was reduced to 0.5 parts on an anhydrous basis.

EXAMPLE 5

A recording material was prepared in the same manner as in Example 1, except that the amount of magnesium sulfate heptahydrate mixed in the coating Composition (2) was increased to 20 parts on an anhydrous basis.

EXAMPLE 6

A recording material was prepared in the same manner as in Example 1, except that aluminum sulfate octadecahydrate in an amount of 4 parts on an anhydrous basis was mixed in the coating Composition (2) in place of the magnesium sulfate heptahydrate.

EXAMPLE 7

A recording material was prepared in the same manner as in Example 1, except that aluminum chloride hexahydrate in an amount of 4 parts on an anhydrous basis was mixed in the coating Composition (2) in place of the magnesium sulfate heptahydrate.

EXAMPLE 8

A recording material was prepared in the same manner as in Example 1, except that aluminum nitrate nonahydrate in an amount of 4 parts on an anhydrous basis was mixed in the coating Composition (2) in place of the magnesium sulfate heptahydrate.

EXAMPLE 9

A recording material was prepared in the same manner as in Example 1, except that sodium thiosulfate pentahydrate in an amount of 4 parts on an anhydrous basis was mixed in the coating Composition (2) in place of the magnesium sulfate heptahydrate.

EXAMPLE 10

A recording material was prepared in the same manner as in Example 1, except that sodium sulfate decahydrate in an amount of 4 parts on an anhydrous basis was mixed in the coating Composition (2) in place of the magnesium sulfate heptahydrate.

EXAMPLE 11

A recording material was prepared in the same manner as in Example 1, except that 4 parts of sodium chloride was mixed in the coating Composition (2) in place of the magnesium sulfate heptahydrate.

EXAMPLE 12

A recording material was prepared in the same manner as in Example 1, except that 4 parts of sodium nitrate was mixed in the coating Composition (2) in place of the magnesium sulfate heptahydrate.

EXAMPLE 13

A recording material was prepared in the same manner as in Example 1, except that potassium thiosulfate trihydrate in an amount of 4 parts on an anhydrous basis was mixed in the coating Composition (2) in place of the magnesium sulfate heptahydrate.

EXAMPLE 14

A recording material was prepared in the same manner as in Example 1, except that 4 parts of potassium sulfate was mixed in the coating Composition (2) in place of the magnesium sulfate heptahydrate.

EXAMPLE 15

A recording material was prepared in the same manner as in Example 1, except that 4 parts of potassium chloride was mixed in the coating Composition (2) in place of the magnesium sulfate heptahydrate.

EXAMPLE 16

A recording material was prepared in the same manner as in Example 1, except that 4 parts of potassium nitrate was mixed in the coating Composition (2) in place of the magnesium sulfate heptahydrate.

EXAMPLE 17

A recording material was prepared in the same manner as in Example 1, except that zinc sulfate heptahydrate in an amount of 4 parts on an anhydrous basis was mixed in the coating Composition (2) in place of the magnesium sulfate heptahydrate.

EXAMPLE 18

A recording material was prepared in the same manner as in Example 1, except that zinc nitrate hexahydrate in an amount of 4 parts on an anhydrous basis was mixed in the coating Composition (2) in place of the magnesium sulfate heptahydrate.

EXAMPLE 19

A recording material was prepared in the same manner as in Example 1, except that zinc acetate dihydrate in an amount of 4 parts on an anhydrous basis was mixed in the coating Composition (2) in place of the magnesium sulfate heptahydrate.

EXAMPLE 20

A recording material was prepared in the same manner as in Example 1, except that magnesium chloride hexahydrate in an amount of 4 parts on an anhydrous basis was mixed in the coating Composition (2) in place of the magnesium sulfate heptahydrate.

EXAMPLE 21

A recording material was prepared in the same manner as in Example 1, except that magnesium thiosulfate hexahydrate in an amount of 4 parts on an anhydrous basis was mixed in the coating Composition (2) in place of the magnesium sulfate heptahydrate.

EXAMPLE 22

A recording material was prepared in the same manner as in Example 1, except that magnesium nitrate hexahydrate in an amount of 4 parts on an anhydrous basis was mixed in the coating Composition (2) in place of the magnesium sulfate heptahydrate.

EXAMPLE 23

A recording material was prepared in the same manner as in Example 1, except that magnesium acetate tetrahydrate in an amount of 4 parts on an anhydrous basis was mixed in the coating Composition (2) in place of the magnesium sulfate heptahydrate.

EXAMPLE 24

A recording material was prepared in the same manner as in Example 2, except that the coverage of the coating Composition (1) was decreased to 0.5 $g/m^2$ on a solids basis and the coverage of the coating Composition (2) was decreased to 3 $g/m^2$ on a solids basis.

EXAMPLE 25

A recording material was prepared in the same manner as in Example 2, except that the coating Composition (1) was not coated.

EXAMPLE 26

A recording material was prepared in the same manner as in Example 2, except that the coating Composition (1) was not coated but the coverage of the coating Composition (2) was increased to 15 $g/m^2$ on a solids basis.

EXAMPLE 27

A recording material was prepared in the same manner as in Example 2, except that the coverage of the coating Composition (1) was increased to 30 g/m$^2$ on a solids basis.

EXAMPLE 28

A recording material was prepared in the same manner as in Example 2, except that the base paper used as support was replaced by a double-side thermoplastic resin-laminated paper (Oper®, trade name, a product of Nippon Paper Industries Co., Ltd.) and the coverage of the coating Composition (1) was increased to 30 g/m$^2$ on a solids basis.

EXAMPLE 29

A recording material was prepared in the same manner as in Example 2, except that the coating Composition (1) was not coated but the coverage of coating Composition (2) was increased to 45 g/m$^2$ on a solids basis.

Comparative Example 1

A recording material was prepared in the same manner as in Example 1, except that magnesium carbonate trihydrate in an amount of 4 parts on an anhydrous basis was mixed in the coating Composition (2) in place of the magnesium sulfate heptahydrate.

Comparative Example 2

A recording material was prepared in the same manner as in Example 1, except that the amount of magnesium sulfate heptahydrate mixed in the coating Composition (2) was reduced to zero.

Comparative Example 3

A recording material was prepared in the same manner as in Example 2, except that the coating Composition (2) was used for the first layer on the base paper and the coating Composition (1) was used for the second layer on the base paper.

Comparative Example 4

A recording material was prepared in the same manner as in Example 1, except that ferrous sulfate heptahydrate in an amount of 4 parts on an anhydrous basis was mixed in the coating Composition (2) in place of the magnesium sulfate heptahydrate.

Results of evaluating suitability of the recording materials prepared in Examples 1 to 29 and Comparative Examples 1 to 4 respectively for pigment ink jet printing are shown in Tables 1 and 2. Additionally, the recording materials can be used without any particular problems when graded ◎ to Δ for their performances as shown in the Tables.

TABLE 1

| Example No. | First Layer Coverage (g/m$^2$, on solids basis) | Second Layer (uppermost layer) Coverage (g/m$^2$, on solids basis) | Metal salt | Amount mixed (parts) | Evaluation Results: Color reproduction | Evaluation Results: Ink absorption | Note |
|---|---|---|---|---|---|---|---|
| 1 | 10 | 5 | $MgSO_4$ | 8 | ◎ | ○ | |
| 2 | 10 | 5 | $MgSO_4$ | 4 | ◎ | ○ | |
| 3 | 10 | 5 | $MgSO_4$ | 2 | ◎ | ○ | |
| 4 | 10 | 5 | $MgSO_4$ | 0.5 | ○ | ○ | |
| 5 | 10 | 5 | $MgSO_4$ | 20 | ◎ | Δ | Coatability was not good |
| 6 | 10 | 5 | $Al_2(SO_4)_3$ | 4 | ◎ | ○ | |
| 7 | 10 | 5 | $AlCl_3$ | 4 | Δ | Δ | |
| 8 | 10 | 5 | $Al(NO_3)_3$ | 4 | Δ | Δ | |
| 9 | 10 | 5 | $Na_2S_2O_3$ | 4 | ○ | ○ | |
| 10 | 10 | 5 | $Na_2SO_4$ | 4 | ○ | ○ | |
| 11 | 10 | 5 | NaCl | 4 | Δ | Δ | |
| 12 | 10 | 5 | $NaNO_3$ | 4 | Δ | Δ | |
| 13 | 10 | 5 | $K_2S_2O_3$ | 4 | ○ | ○ | |
| 14 | 10 | 5 | $K_2SO_4$ | 4 | ○ | ○ | |
| 15 | 10 | 5 | KCl | 4 | Δ | Δ | |
| 16 | 10 | 5 | $KNO_3$ | 4 | Δ | Δ | |
| 17 | 10 | 5 | $ZnSO_4$ | 4 | ○ | ○ | |
| 18 | 10 | 5 | $Zn(NO_3)_2$ | 4 | Δ | Δ | |
| 19 | 10 | 5 | $Zn(CH_3COO)_2$ | 4 | Δ | Δ | |
| 20 | 10 | 5 | $MgCl_2$ | 4 | Δ | Δ | |
| 21 | 10 | 5 | $MgS_2O_3$ | 4 | ○ | ○ | |
| 22 | 10 | 5 | $Mg(NO_3)_2$ | 4 | Δ | Δ | |
| 23 | 10 | 5 | $Mg(CH_3COO)_2$ | 4 | Δ | Δ | |
| 24 | 0.5 | 3 | $MgSO_4$ | 4 | ○ | Δ | |
| 25 | — | 5 | $MgSO_4$ | 4 | ○ | ○ | |
| 26 | — | 15 | $MgSO_4$ | 4 | ◎ | ○ | |
| 27 | 30 | 5 | $MgSO_4$ | 4 | ◎ | ◎ | |

TABLE 1-continued

| Example No. | First Layer Coverage (g/m², on solids basis) | Second Layer (uppermost layer) Coverage (g/m², on solids basis) | Metal salt | Amount mixed (parts) | Evaluation Results Color reproduction | Ink absorption | Note |
|---|---|---|---|---|---|---|---|
| 28 | 30 | 5 | $MgSO_4$ | 4 | ○ | ○ | Laminated paper was used as a support |
| 29 | — | 45 | $MgSO_4$ | 4 | Δ | ○ | Uppermost layer surface came off in powder |

TABLE 2

| Comparative Example No. | First Layer Coverage (g/m2, on solids basis) | First Layer Metal salt | First Layer Amount mixed (parts) | Second Layer (uppermost layer) Coverage (g/m2, on solids basis) | Second Layer Metal salt | Second Layer Amount mixed (parts) | Evaluation Results Color reproduction | Ink absorption | note |
|---|---|---|---|---|---|---|---|---|---|
| 1 | 10 | — | — | 5 | $MgCO_3$ | 4 | X | ○ | |
| 2 | 10 | — | — | 5 | — | — | X | ○ | |
| 3 | 10 | $MgSO_4$ | 4 | 5 | — | — | X | ○ | |
| 4 | 10 | — | — | 5 | $FeSO_4$ | 4 | X | ○ | Ink receiving layer was colored |

Dye Ink Jet Recording Test

Solid black patterns were recorded on each of the recording materials prepared in Examples 1 and 6 by means of an ink-jet printer using dye ink, Model PM-770C (trade name, a product of Seiko Epson Corp.). The recorded areas were examined for metallic gloss. The results obtained are shown in Table 3.

TABLE 3

| | Metal salt mixed in uppermost layer | Metallic gloss |
|---|---|---|
| Example 1 | $MgSO_4$ | absent |
| Example 6 | $Al_2(SO_4)_3$ | present |

As can be seen from the results shown in Tables 1 to 3, the recording materials according to embodiments of the invention were well suited for ink jet recording processes for pigment ink, and ensured both high ink absorption and satisfactory color reproduction in the images recorded thereon.

Examples (A), (B) and (C) demonstrate the effect of the location of the layer containing the water-soluble metal salt. The results are in Table 4.

Example (A) corresponds to Example 2. Example (B) is prepared in the same manner as Example 2, except that 4 parts by weight of magnesium sulfate heptahydrate was added only in the coating solution (1) but was not added in the coating solution (2). Example (C) is prepared in the same manner as Example 2, except that 4 parts by weight of magnesium sulfate heptahydrate was also added in the coating solution (1).

TABLE 4

| | (A) | (B) | (C) |
|---|---|---|---|
| Number of coated layers | 2 | 2 | 2 |
| Layer wherein water soluble metal salt is contained | The first layer (Uppermost layer | The second layer | The first layer and the second layer |
| Water soluble metal salt | $MgSO_4$ | $MgSO_4$ | $MgSO_4$ |
| Amount of water soluble metal salt per 100 weight parts of pigment | Upper layer 4.0<br>Lower layer 0 | Upper layer 0<br>Lower layer 4.0 | Upper layer 4.0<br>Lower layer 4.0 |
| Recording density (Sum of 4 colors) | 6.07 (◎) | 5.44 (○) | 5.36 (603 ) |
| Ink absorption property | ○ | Δ | Δ |

Examples (i) to (viii) demonstrate the effect of the amount of water-soluble metal salt in the uppermost layer. The results are in Table 5.

Examples (i) to (viii) were prepared in the same manner as Example 1, except with variations in the amount of water-soluble metal salt in the uppermost layer. Example (v) corresponds to Example 1.

TABLE 5

| | (i) | (ii) | (iii) | (iv) | (v) | (vi) | (vii) | (viii) |
|---|---|---|---|---|---|---|---|---|
| Amount of water soluble metal salt in the uppermost layer (per 100 weight parts of pigment) | 0 | 0.5 | 2.0 | 4.0 | 8.0 | 15 | 20 | 40 |
| Water soluble metal salt | | | | $MgSO_4$ | | | | |
| Recording density (Sum of 4 colors) | 4.85 | 6.01 | 6.08 | 6.07 | 6.03 | 5.90 | 5.63 | 5.33 |
| Ink absorption property | Δ ○ | (◎) ○ | (◎) ○ | (◎) ○ | (◎) ○ | (○) ○ | (○) Δ | (○) X |

Examples (a) to (e) demonstrate the effect of the coverage of the uppermost layer. The results are in Table 6.

Examples (a) to (e) were prepared in the same manner as Example 1, except with variations in the coverage of the uppermost layer. Example (b) corresponds to Example 1.

TABLE 6

| | (a) | (b) | (c) | (d) | (e) |
|---|---|---|---|---|---|
| Coverage of the uppermost layer ($g/m^2$) | 3 | 5 | 8 | 10 | 12 |
| Water soluble metal salt | | | $MgSO_4$ | | |
| Recording density (Sum of 4 colors) | 6.07 (◎) | 6.07 (◎) | 6.01 (◎) | 5.85 (○) | 5.76 (○) |
| Ink absorption property | ○ | ○ | ○ | ○ | ○ |

The entire disclosures of all applications, patents and publications, cited herein and of corresponding Japanese application Nos. 2000-023431, filed Jan. 31, 2000 and 2001-008679, filed Jan. 17, 2001 and U.S. Ser. No. 09/77 1,964, filed Jan. 30, 2001 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An ink-jet recording material having on a support multiple ink-receiving layers each comprising pigment and binder, which are suitable for an ink-jet process using pigment ink, said material further containing in the uppermost layer of said ink-receiving layers at least one water-soluble acidic or neutral metal salt selected from the group consisting of aluminum salts, magnesium salts, sodium salts, potassium salts and zinc salts, wherein the water-soluble metal salt is contained in an amount of 0.5 to 10 parts by weight per 100 parts by weight of pigment in the uppermost ink-receiving layer, and wherein the layer or layers that are not the uppermost layer contain no or substantially no water-soluble acidic or neutral metal salt.

2. An ink-jet recording material as described in claim 1, wherein the water-soluble metal salt contains, as its constituent anion, an anion selected from the group consisting of sulfate ion, chloride ion, thiosulfate ion, nitrate ion and acetate ion.

3. An ink-jet recording material as described in claim 2, wherein the water-soluble metal salt is magnesium sulfate, aluminum sulfate, sodium thiosulfate or potassium thiosulfate.

4. An ink-jet recording material as described in claim 3, wherein the water-soluble metal salt is magnesium sulfate.

5. An ink-jet recording material as described in claim 3, wherein the water-soluble metal salt is aluminum sulfate.

6. An ink-jet recording material as described in claim 3, wherein the water-soluble metal salt is sodium thiosulfate.

7. An ink-jet recording material as described in claim 3, wherein the water-soluble metal salt is potassium thiosulfate.

8. An ink-jet recording material as described in claim 1, wherein the water-soluble metal salt is contained in an amount of 0.5 to 8 parts by weight per 100 parts by weight of pigment in the uppermost ink-receiving layer.

9. An ink-jet recording material according to claim 1, wherein the multiple ink-receiving layers are two ink-receiving layers.

10. An ink-jet recording material according to claim 1, wherein the coverage of the uppermost ink-receiving layer is 3 to 5 $g/m^2$.

11. An ink-jet recording material according to claim 8, wherein the coverage of the uppermost ink-receiving layer is 3 to 5 $g/m^2$.

12. An ink-jet recording material as described in claim 8, wherein the water-soluble metal salt is magnesium sulfate.

13. An ink-jet recording material as described in claim 10, wherein the water-soluble metal salt is magnesium sulfate.

14. An ink-jet recording material as described in claim 11, wherein the water-soluble metal salt is magnesium sulfate.

15. An ink-jet recording material according to claim 8, wherein the multiple ink-receiving layers are two ink-receiving layers.

16. An ink-jet recording material according to claim 10, wherein the multiple ink-receiving layers are two ink-receiving layers.

17. An ink-jet recording material according to claim 11, wherein the multiple ink-receiving layers are two ink-receiving layers.

18. A method of preparing an ink-jet recording material according to claim 1, comprising providing multiple ink-receiving layers on a support, each layer comprising pigment and binder, which are suitable for an ink-jet process using pigment ink, the uppermost layer of said ink-receiving layers further containing at least one water-soluble acidic or neutral metal salt selected from the group consisting of aluminum salts, magnesium salts, sodium salts, potassium salts and zinc salts, wherein the water-soluble metal salt is contained in an amount of 0.5 to 10 parts by weight per 100 parts by weight of pigment in the uppermost ink-receiving layer, and wherein the layer or layers that are not the uppermost layer contain no or substantially no water-soluble acidic or neutral metal salt.

19. In an ink-jet recording process, the improvement wherein is the use of an ink-jet recording material according to claim 1.

* * * * *